US006609633B1

(12) United States Patent
Dyble et al.

(10) Patent No.: US 6,609,633 B1
(45) Date of Patent: Aug. 26, 2003

(54) RECLOSABLE THERMOFORMED HINGED CONTAINER

(75) Inventors: Richard J. Dyble, Janesville, WI (US); Edward A. Stamm, Janesville, WI (US); Steven J. Gottschall, Janesville, WI (US)

(73) Assignee: Panoramic, Inc., Janesville, WI (US)

( * ) Notice: Subject to any disclaimer, the term of this patent is extended or adjusted under 35 U.S.C. 154(b) by 302 days.

(21) Appl. No.: 09/713,787

(22) Filed: Nov. 15, 2000

(51) Int. Cl.[7] ..... B65D 43/16
(52) U.S. Cl. ..... 220/840; 220/4.23
(58) Field of Search ..... 220/4.22, 4.23, 220/4.24, 836, 840, 842, 845, FOR 192, FOR 195, FOR 196, FOR 199

(56) References Cited

U.S. PATENT DOCUMENTS

| | | | | |
|---|---|---|---|---|
| 2,185,604 A | * | 1/1940 | Moore | 229/123.1 |
| 3,086,676 A | * | 4/1963 | Dilatush | 220/833 |
| 3,576,271 A | | 4/1971 | Seeley | |
| 3,933,295 A | * | 1/1976 | Congleton | 220/4.24 |
| 4,005,800 A | * | 2/1977 | Schurman | 220/840 |
| 4,739,883 A | * | 4/1988 | Mohs et al. | 206/470 |
| 4,789,078 A | * | 12/1988 | Miller et al. | 220/832 |
| 4,822,553 A | | 4/1989 | Marshall | |
| 4,892,220 A | | 1/1990 | Foos | |
| 5,119,966 A | * | 6/1992 | McKim et al. | 220/836 |
| 5,147,035 A | | 9/1992 | Hartman | |
| 5,873,461 A | | 2/1999 | Turbett et al. | |

FOREIGN PATENT DOCUMENTS

FR 2594657 * 8/1987

OTHER PUBLICATIONS

Panoramic, Inc. drawing 1999, Tub Assy, Drypers #06–980132 Baby Wipes.

* cited by examiner

*Primary Examiner*—Nathan J. Newhouse
(74) *Attorney, Agent, or Firm*—Foley & Lardner

(57) ABSTRACT

A thermoformed container is formed with a receptacle and a separate cover which is hingeably and detachably attached to the receptacle. The receptacle and cover each have a hinge flange with side skirt walls descending therefrom in which indentations are formed during the thermoforming process. The indentations on one of the cover or receptacle form pivot pins which seat in the sockets defined by the indentations on the other of the cover or the receptacle, defining an axis of rotation about which the cover can rotate with respect to the receptacle. The cover and receptacle can thus can be formed of different plastics or of plastics in which conventional integral living hinges can not be used. The pivot pin indentations are produced in the thermoforming process by forming pins which engage into the softened sheet at the side skirt walls. The plastic material cools and hardens to form sharply defined pivot pins.

19 Claims, 8 Drawing Sheets

RECLOSABLE THERMOFORMED HINGED CONTAINER

FIELD OF THE INVENTION

This invention pertains generally to the field of plastic packaging and particularly to thermoformed plastic containers.

BACKGROUND OF THE INVENTION

Reclosable plastic containers are used for the packaging of a wide variety of products which will be held in the container and utilized by the consumer over a period of time. The containers may be utilized to enclose and protect products that are periodically used, such as a compact disk, a videotape, an audio tape, etc., or to contain multiple products which are used by the consumer one at a time, e.g., diapers, paper napkins, disposable wipes, screws, fasteners, etc. The cover for such reclosable containers is typically connected to a receptacle by a hinge about which the cover rotates when opened by the consumer to permit access to the interior of the container.

Various production processes are used to form plastic containers. Injection molding is well suited to the formation of relatively thick-walled, rigid plastic containers of the type that are intended for long-term use by the consumer. A variety of hinge structures are possible in injection molded containers because of the flexibility offered by the injection molding process. However, injection molding is not economically well suited to the production of plastic containers intended for use in the packaging of relatively low cost products. The molds used in injection molding processes are expensive, and the injection molding process itself is a relatively slow production process involving complex equipment which must be carefully monitored and controlled.

For the production of relatively low cost plastic containers for use in the packaging of bulk or relatively inexpensive consumer products, the thermoforming process is more widely used. In the thermoforming process, a thin sheet of thermoplastic is held over a mold and is heated to a temperature at which it can be plastically deformed. The heated plastic is then drawn using vacuum and pressure into the mold where it conforms to the surfaces of the mold, cools, and hardens to retain the shape of the mold. The formed product can then be die cut from the surrounding sheet, removed from the mold, and a new section of plastic sheet advanced into place over the mold. This thermoforming process, and variations on it, can be carried on in a continuous production process, allowing very high production volumes and low unit costs. These processes are used to form the common "blister packs" in which a product is sealed between the formed plastic "blister" and a removable panel, commonly of paperboard. Such blister packaging is relatively inexpensive and is typically discarded after the package is opened by the consumer.

Reclosable hinged plastic containers may also be made by the thermoforming process. Typically, the receptacle of the container and the cover are formed integrally from the same sheet of plastic and are joined together by a so-called "living hinge" which flexibly joins the cover and the receptacle. The plastic of the living hinge is sometimes thinned during the forming process to make it more flexible. While such integrally formed reclosable containers can be made very economically, and are extensively used in the packaging of a wide variety of products, the integral cover and receptacle structure has certain inherent limitations. Generally, the cover and receptacle must be formed of the same plastic. Although it is possible to thermoform containers having a different plastic material for the cover and the receptacle, by utilizing a sheet of two separate plastics joined together, the choice of plastics that can be used is limited and the requirement for special plastic sheet stock makes the process less economical. Furthermore, some types of common plastics are not well suited to be formed with a living hinge because of the inherent rigidity or vulnerability to fatigue failure of the plastic material. Polystyrene is an example of a type of plastic commonly used in packaging but not well suited to the use of an integral living hinge. Containers formed with living hinges may also suffer from a bias or memory in the hinge which tends to draw the cover partially open. In certain situations, it may be disadvantageous to utilize containers with integrally formed covers, for example, where the cover is to be printed, labeled or decorated after forming, or where the cover may interfere with or complicate the automated filling of the receptacle with the end product.

Thus, it would be desirable to be able to produce containers by the thermoforming process in which the cover and receptacle were formed separately and then joined later by hinge structures formed in the cover and receptacle during the thermoforming operation. However, the thermoforming process is not well suited to the formation of structures of the type that would be analogous to the hinge pins and pivots that are utilized in, for example, reclosable injection molded containers. Because the thermoforming process utilizes a plastic sheet which has been softened by heating (but is not a liquid), the process is not well suited to form small projections or other structures that are sharply defined and have relatively small dimensions.

SUMMARY OF THE INVENTION

In accordance with the invention, a reclosable thermoformed hinged container has a separate cover and receptacle which are both produced by the thermoforming process in an efficient and economical manner. If desired, the cover and receptacle can be made of different plastic materials, of different gauge materials, in different colors and with different finishes. The separate cover and receptacle are well suited for compact shipping from the point of production of the container to the point of assembly where the receptacles are filled with the end product, since the separate cover and receptacle can be nestably stacked to provide a very compact product for shipment with minimal dead air space. The separate forming of the cover from the receptacle allows the cover to be formed with graphical material embossed therein utilizing processing conditions (e.g., heating temperature, dwell times in the mold, etc.) different from that required for forming the receptacle, and the cover is well suited to being decorated before it is assembled to the receptacle.

In accordance with the invention, hinge structures are formed in the cover and receptacle during the thermoforming process in which the cover and receptacle are separately produced. These hinge structures are formed in a manner which does not require disruption or modification of the normal thermoforming process sequence. The receptacle has an open top and is formed of a thermoformed sheet of plastic material having a hinge edge at its top, a hinge flange extending outwardly from the hinge edge, side skirt walls extending from the hinge flange generally perpendicular to the hinge edge, and an indentation formed in each side skirt wall. The cover is formed of a thermoformed sheet of plastic material and has a hinge edge, a hinge flange extending outwardly from the hinge edge, side skirt walls extending from the hinge flange generally perpendicular to the hinge edge, and an indentation formed in each of the side skirt walls of the cover. The indentations are formed in the side skirt walls of each of the receptacle and the cover along an axis of rotation. The indentations on one of the cover or the receptacle form hinge pins which, when the cover is assembled onto the receptacle, seat in the indentations in the side skirt walls of the other of the cover or receptacle to define a hinge at the axis of rotation. Assembly of the cover to the base receptacle can be easily carried out by pressing the cover onto the receptacle until the hinge pins snap fit and seat into the indentations.

In a preferred construction for the container, the hinge flange on the cover is formed to fit over the hinge flange on the receptacle, with the side skirt walls of the cover extending down over and adjacent to the side skirt walls of the receptacle. The indentations in the side skirt walls of the cover form hinge pins which extend inwardly toward one another along the axis of rotation. These hinge pins seat in sockets defined by inwardly formed indentations formed in the side skirt walls of the receptacle. An outer skirt wall may descend from the hinge flange on the cover and be integrally joined to the side skirt walls of the cover. An outer skirt wall preferably also descends from the hinge flange of the receptacle and is integrally joined with the side skirt walls of the receptacle. The receptacle may include a rim extending around the perimeter of the open top of the receptacle except where the hinge flange extends from the hinge edge, with the rim preferably comprising an outwardly extending flange and a skirt wall that extends downwardly from the outwardly extending flange and that is formed integrally therewith. The rim structure provides a smoothly formed top for the receptacle and rigidifies the structure of the receptacle. Latch structures may be formed at the front of the cover and receptacle which engage with one another to hold the cover in its closed position until opened by the user.

A particular advantage of the present invention is that the cover and receptacle may be formed of plastics, such as polystyrene, which are not well suited to use in containers having integral living hinges. The present invention thus allows containers to be formed of such plastics using the highly efficient and economical thermoforming process rather than more expensive processes, such as injection molding.

In the process for forming the receptacle or cover in accordance with the invention, a sheet of thermoplastic material of which the container is to be made is advanced over a thermoforming mold in conventional thermoforming equipment. Heat is then applied to the sheet material to heat it above its plastic transition temperature, and the softened plastic is then drawn by vacuum into the mold to conform the plastic material to the surfaces of the mold. The surfaces of the mold define the structure of the receptacle or cover including the hinge flange and the side skirt walls extending therefrom. As the sheet material in the softened state is drawn into the mold, forming pins engage the sheet material in the side skirt walls to form indentations therein. After the sheet material has cooled and hardened, the forming pins are withdrawn as the shaped product defined by the surfaces of the mold is removed from the mold. The forming pins then are advanced back into position where they can engage another sheet of material drawn into the mold. The forming pins may each be mounted on articulated forming tools which rotate about a pivot point from a position in which the forming pins are withdrawn below the adjacent surfaces of the mold to a position in which the forming pins are advanced beyond the surfaces of the mold to engage into the softened plastic sheet material of the side skirt walls. After the indentations have been formed and the sheet material has cooled and hardened, the forming tools rotate to withdraw the forming pins below the surface of the mold as the formed plastic part is withdrawn from the mold, allowing the formed part to be removed from the mold without interference from the forming pins. The process requires no change in the normal thermoforming processing steps and no significant additional processing time for the production of the formed plastic parts.

Further object, features and advantages of the invention will be apparent from the following detailed description when taken in conjunction with the accompanying drawings.

DETAILED DESCRIPTION OF THE INVENTION

Figure 1:
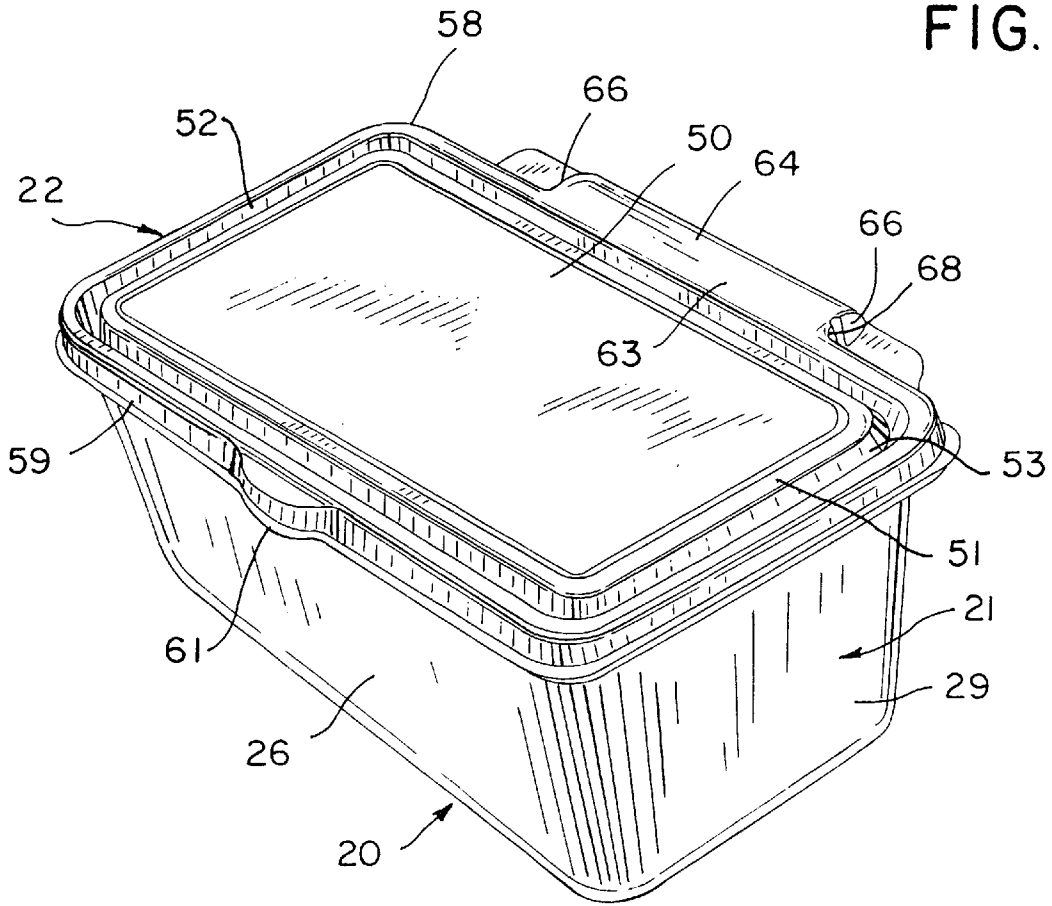
FIG. 1 is a perspective view of a reclosable thermoformed hinged container in accordance with the invention shown in its closed position.
Figure 2:
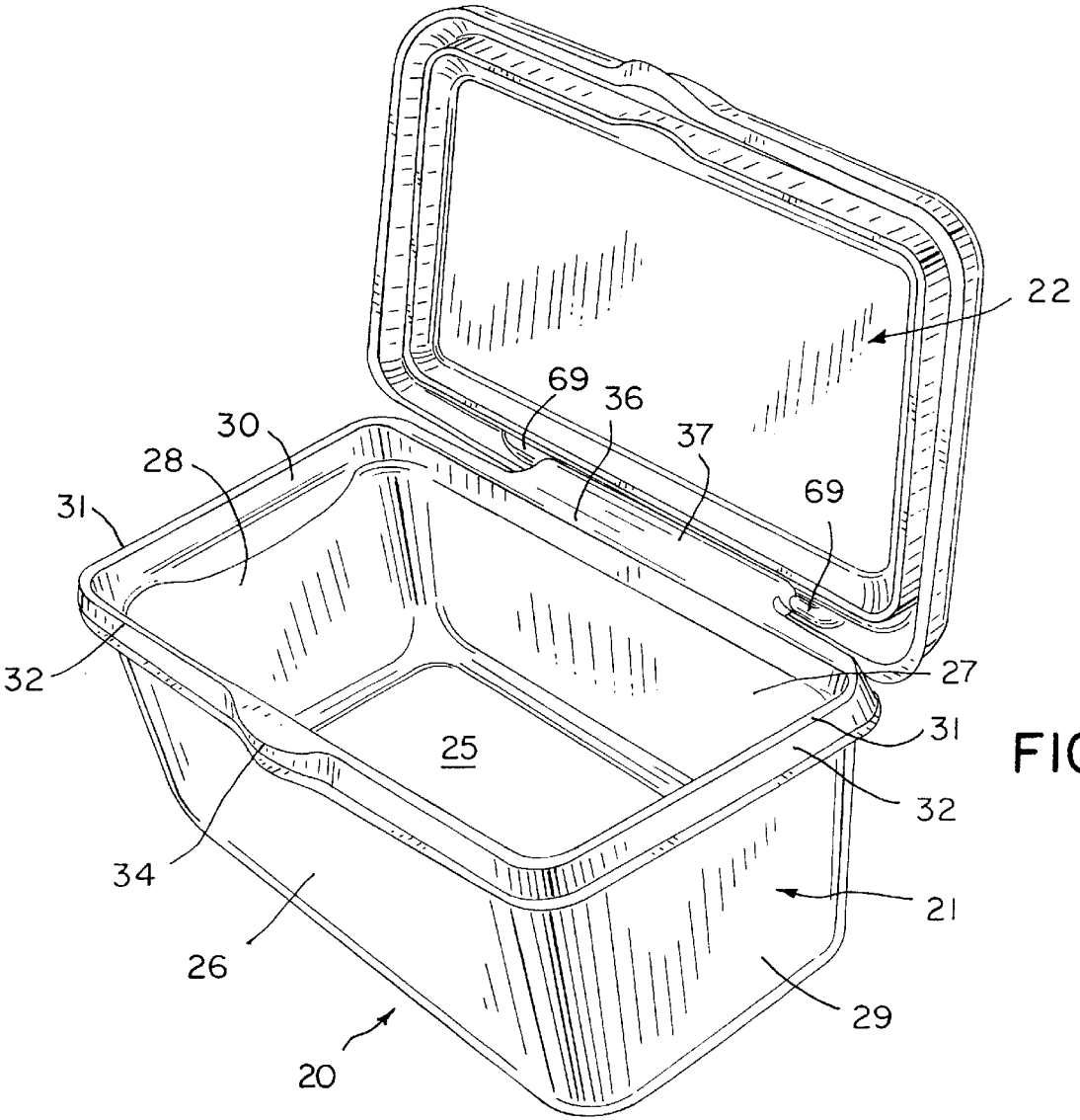
FIG. 2 is a perspective view of the container of the invention shown in its open position.
Figure 3:
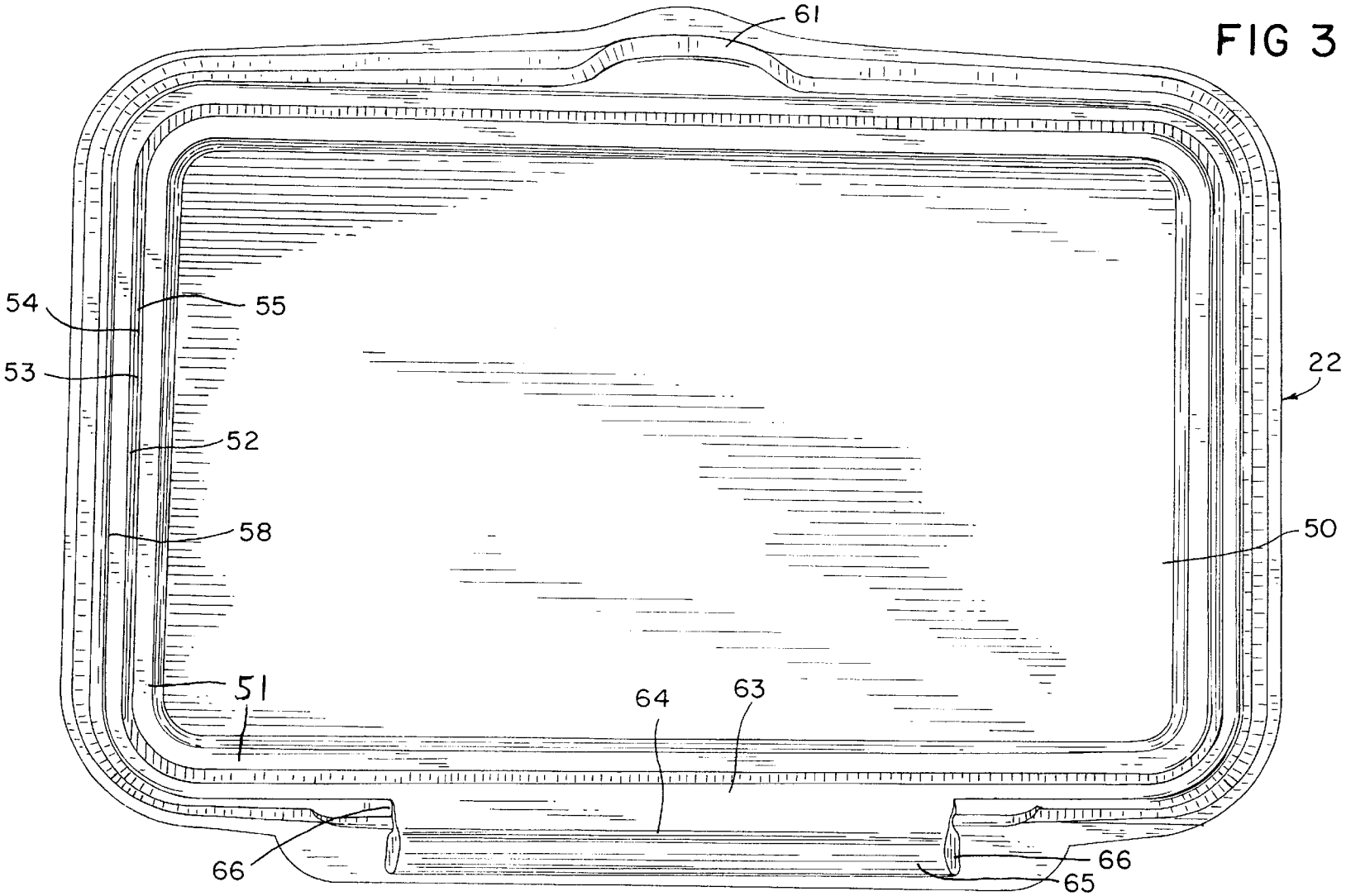
FIG. 3 is a plan view of the cover portion of the container of the invention.

With reference to the drawings, a reclosable thermoformed container in accordance with the invention is shown generally at 20 in a closed position in FIG. 1, and in FIG. 2 in its open position. The container 20 has a receptacle 21 and a cover 22 which is hingedly and detachably attached to the receptacle 21. The container 20 will be described below with reference to a generally rectangular geometry for the receptacle 21 and cover 22, although it is understood that the invention may be incorporated in various other geometries used for packaging containers, e.g., square, polygonal, etc. The receptacle 21 and the cover 22 are both thermoformed of a thermoplastic sheet material, as described further below.

Figure 4:
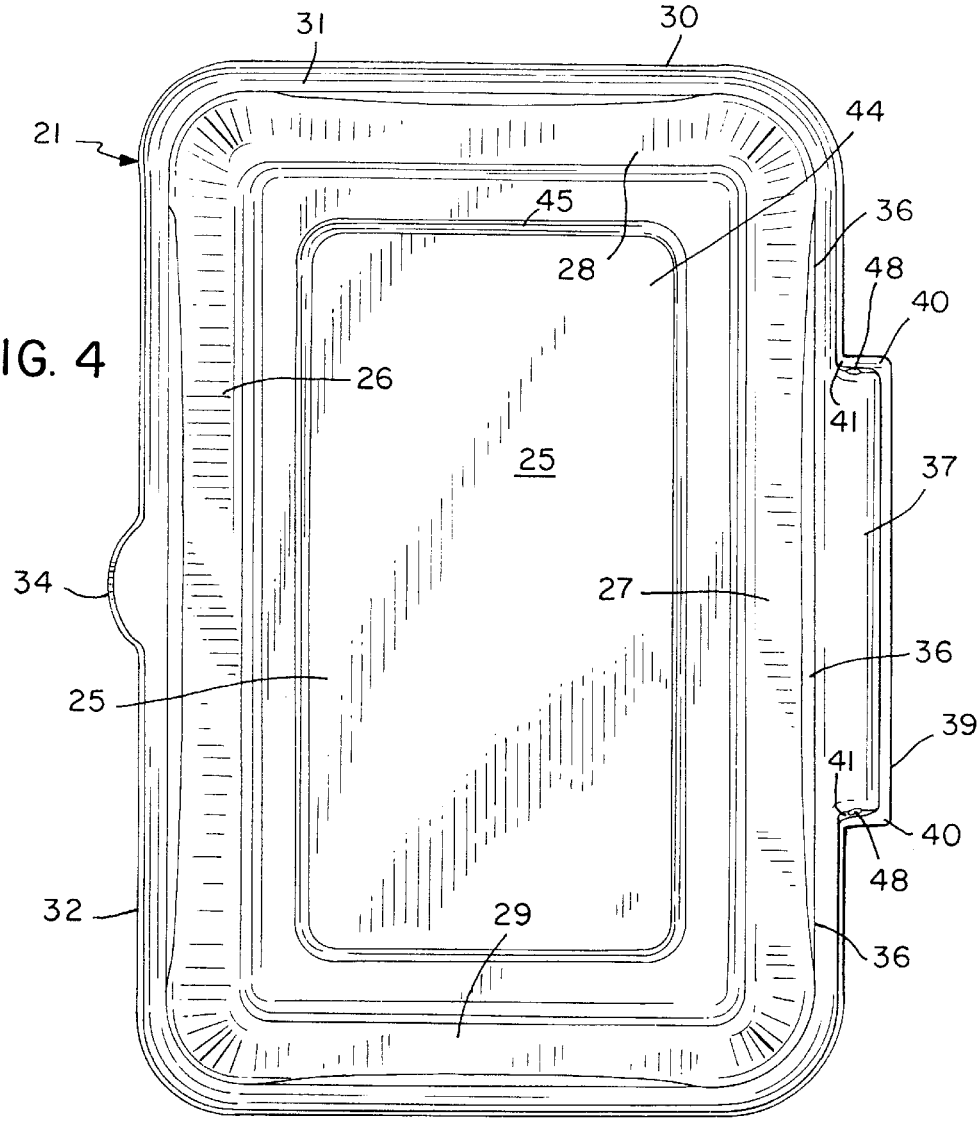
FIG. 4 is a plan view of the receptacle portion of the container.
Figure 5:
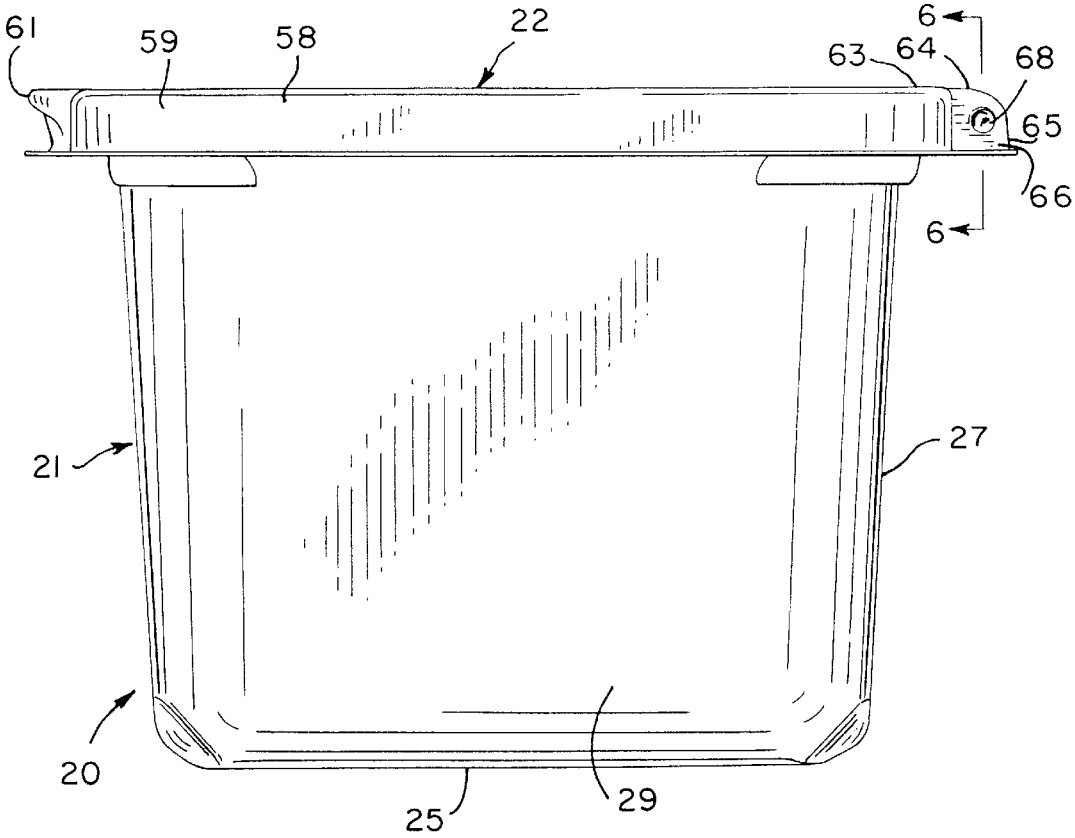
FIG. 5 is a side view of the container of the invention shown in its closed position taken from the right hand side of the container.

For exemplification, the rectangularly shaped receptacle 21 has a bottom wall 25, a front wall 26, a back wall 27, a left sidewall 28, and a right sidewall 29, with the walls 25, 26, 27, 28 and 29 being integrally formed together of a single sheet of plastic. The receptacle 21 has an open top defined by a top rim 30 that extends around the perimeter of the top of the receptacle 21. For purposes of rigidifying the receptacle 21 and maintaining the cut edges of the plastic of the container away from the user, the rim 30 around most of the top periphery includes a short outwardly extending flange 31 at the outer edge of which is formed a downwardly extending skirt 32. A latch protrusion 34 is formed in the rim at the front of the receptacle and extends outwardly from the adjacent portions of the skirt 32 to form an undercut surface which can be used to latch the cover in a closed position, as discussed further below. The receptacle 21 includes a hinge edge 36 lying generally along the portion of the rim 31 at the back of the receptacle 21 at the edge of the back wall 27. A hinge flange 37 extends outwardly from the hinge edge 36. An outer skirt wall 39 extends downwardly from the outer edge of the hinge flange 37, and two side skirt walls 40 descend downwardly from opposite side edges 41 of the flange 37, as best shown in the top plan view of the receptacle in FIG. 4. The hinge edge 36 generally lies in a straight line at the top of the back wall 27 of the receptacle. The side skirt walls 40 of the flange lie generally in planes which are at or close to perpendicular to the axis defined by the hinge edge 36 of the receptacle. The peripheral skirt 32, the side skirt walls 40 and the flange skirt 39 are all integrally joined to form a continuous skirt around the perimeter of the receptacle. These structures are readily formed in the thermoforming process by sections of the mold into which the sheet being thermoformed is drawn.

The receptacle 21 may have various design features that are conventional in thermoformed containers, including inward sloping of the front, back and sidewalls from the top rim to the bottom wall to facilitate removal of the formed part from the mold and nestable stacking of the receptacles, and outward flaring of the skirts 32, 39 and 40. The bottom wall 25 may include an upraised central section 44 joining the remainder of the bottom wall at a joining wall 45 to help rigidify the bottom of the container, and other indentations may be formed in the front, back and sidewalls for the same reason in a conventional manner.

Inwardly extending hemispherical indentations 48 are formed in the side skirt walls 40. These indentations are relatively shallow reentrant formations in the plastic sheet which generally can be formed using the conventional thermoforming process. These indentations 48 form sockets which receive hinge pins formed on the cover and define the receptacle portion of the hinge by which the cover is hingedly attached to the receptacle.

Figure 6:
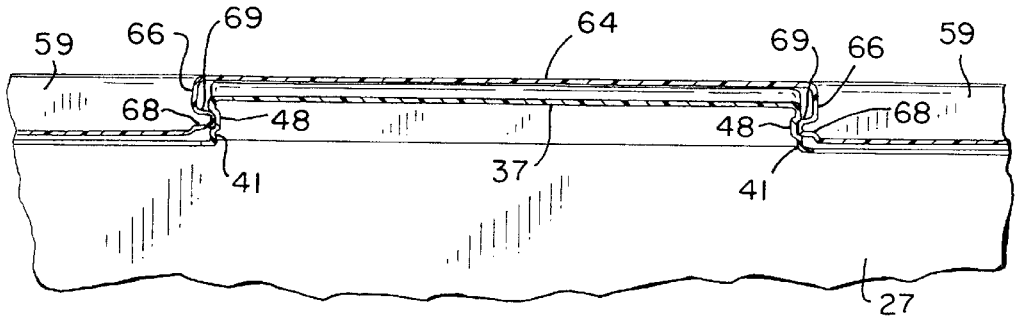
FIG. 6 is a cross sectional view through the hinge structure of the container taken generally along the line 6—6 of FIG. 5.

The cover 22 is formed of a plastic sheet in a thermoforming process separately from the receptacle 21. The geometric shape of the cover 22 is selected to match that of the top of the receptacle 21—in the example shown in the figures, a generally rectangular shape. For purposes of illustration, the cover 22 has a central flat panel 50 bordered by an embossed rim 51 and a valley section 52 which extends from the embossed rim 51. The valley section 52 includes a downwardly extending section 53, a bottom edge 54, and an upwardly extending section 55. Formed continuously around the periphery of the cover with the valley section 52 is an outer rim 58. A skirt 59 extends downwardly from the outer edge of the rim 58 around most of the periphery of the cover. The sections 51, 58 and 59 together define a downwardly open slot or pocket into which the rim 31 of the receptacle can fit when the cover 22 is closed onto the receptacle 21. An outwardly extending latch section 61 is formed at the front edge of the rim 58 and has an overhanging section which is formed to mate and engage with the latch protrusion 34 on the receptacle. The cover has a hinge edge 63 extending along the back of the cover generally defining a straight line. A cover hinge flange 64 extends outwardly from the hinge edge 63 and has a downwardly extending outer skirt section 65 and downwardly extending side skirt walls 66 which lie generally in planes substantially perpendicular to the axis of the hinge edge 63. Each of the side skirt walls 66 have an indentation 68 formed therein. The indentations 68 define pivot pins 69 which extend inwardly toward each other and lie on and define an axis of rotation that is generally parallel to the hinge edge 63. As best illustrated in the cross-sectional view of FIG. 6, the inwardly facing pivot pins 69 formed by the indentations 68 in the cover are hollow and are spaced apart from each other a selected distance so that they fit into and snuggly engage the sockets defined by the indentations 48 formed in the receptacle. The hinge or pivot pins 69 thus can rotate in the socket indentations 48, allowing the cover to hingedly swing open or closed around an axis of rotation in the hinge defined by the structures of the indentations 48 and 68. The reentrant indentations 68 are relatively small in diameter (e.g., in the range of ⅛ inch diameter), sharply defined structures. In contrast to conventional injection molded hinge pins, the hinge pins 69 defined by the indentations 68 are hollow. The pivot pins 69 preferably have a hemispherical end which seats in a hemispherical socket defined by the indentations 48 in the receptacle.

Figure 7:
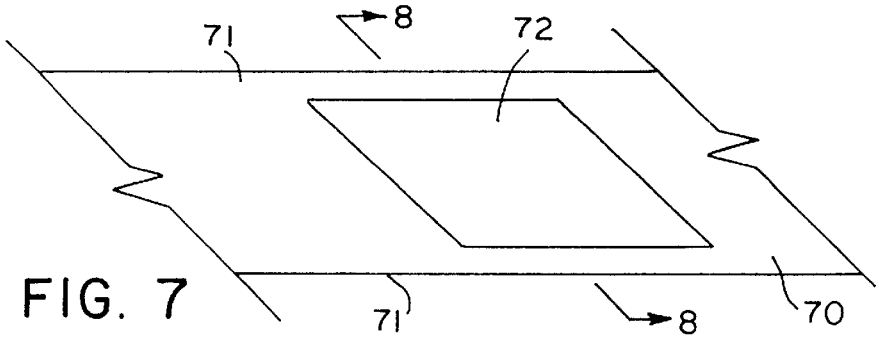
FIG. 7 is a simplified perspective view of a sheet of thermoplastic material being advanced above a mold in the thermoforming process.
Figure 8:
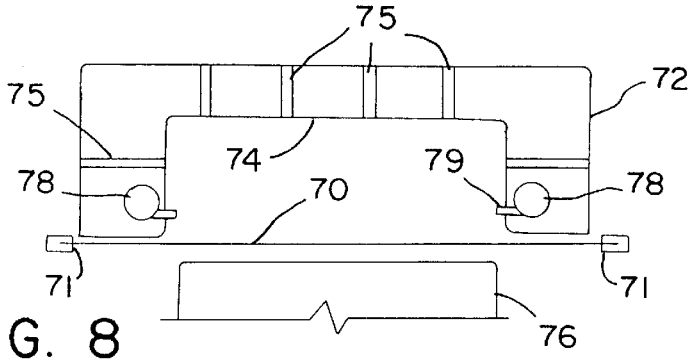
FIG. 8 is a simplified schematic cross sectional view of a plastic sheet held above a mold in the thermoforming process in accordance with the invention.
Figure 9:
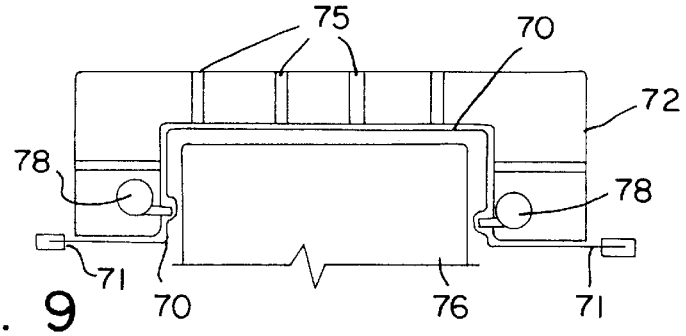
FIG. 9 is a view similar to FIG. 8 at a further step in the thermoforming process.
Figure 10:
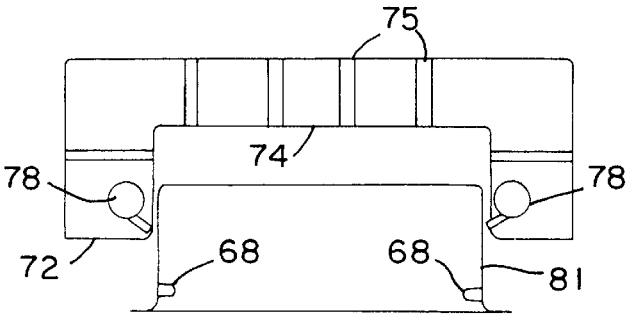
FIG. 10 is a view similar to FIG. 8 at another step in the thermoforming process.
Figure 11:
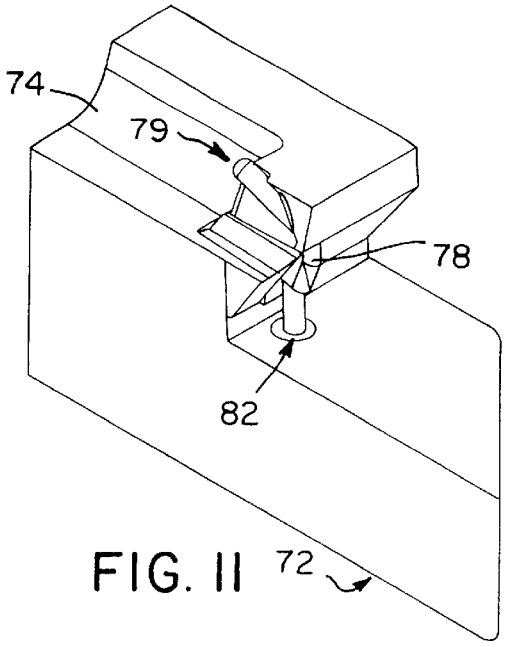
FIG. 11 is a partial perspective view of an articulated forming tool and adjacent portions of the thermoforming mold in accordance with the invention, with the forming pin shown in its retracted position.
Figure 12:
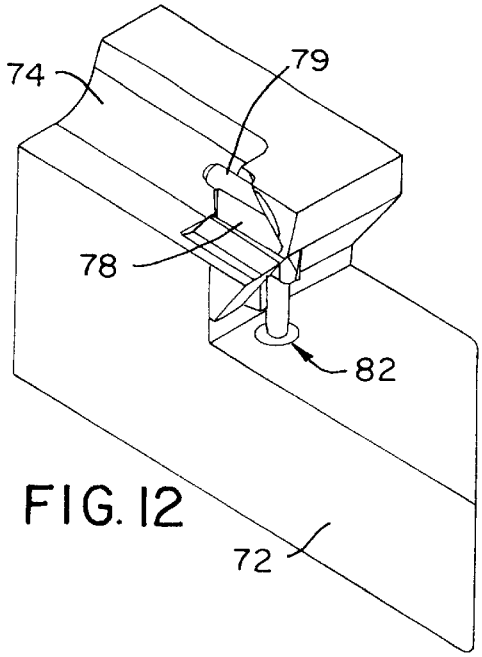
FIG. 12 is a view similar to FIG. 11 showing the forming tool rotated with the forming pin its advanced position.
Figure 13:
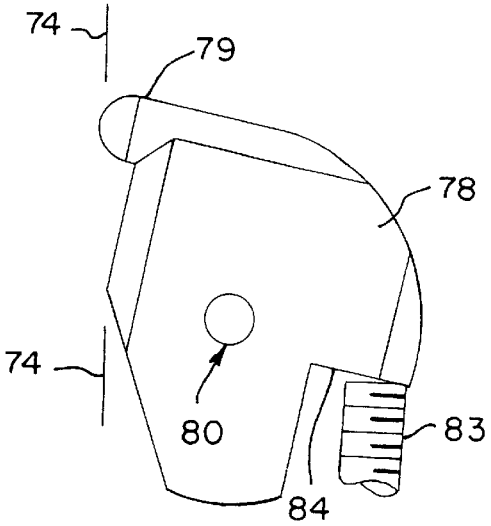
FIG. 13 is a view of the forming tool in accordance with the invention showing the forming pin in its retracted position.
Figure 14:
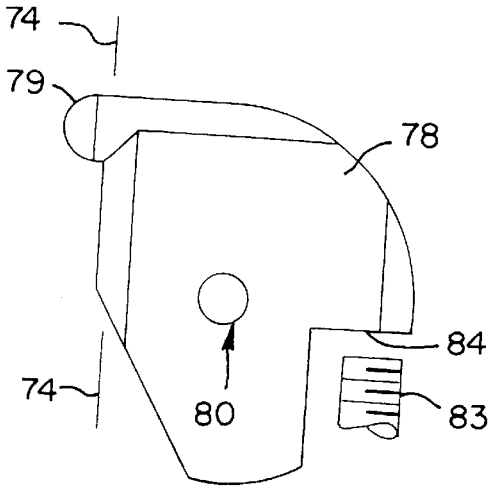
FIG. 14 is a view similar to FIG. 13 with the forming pin in its advanced position.
Figure 15:
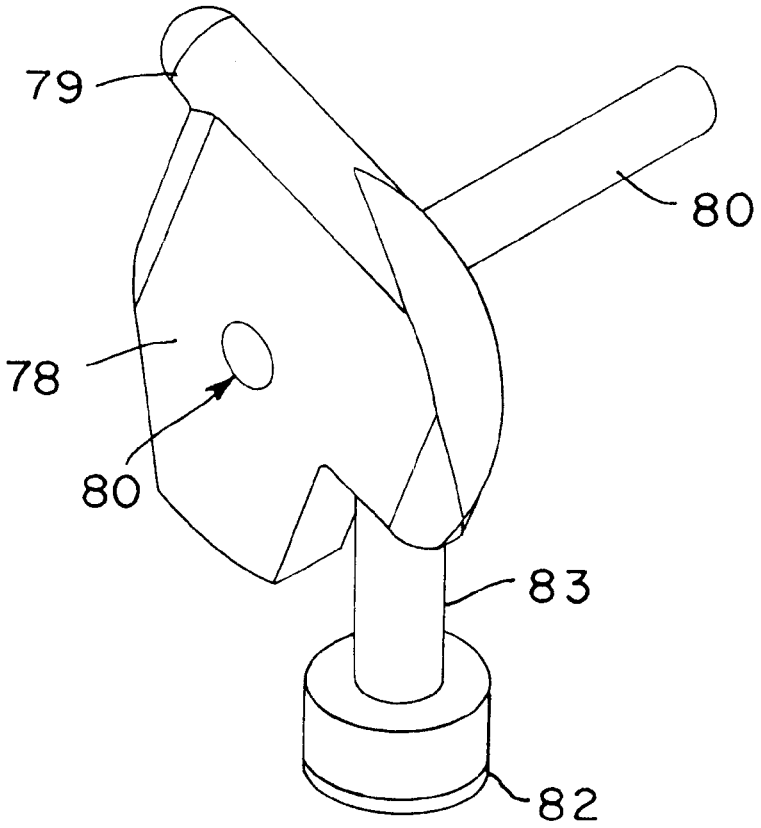
FIG. 15 is a perspective view of the articulated forming tool and the adjacent pivot stop.

FIGS. 7–10 are simplified views illustrating the formation of the reentrant indentations in a thermoformed plastic sheet that form the hinge structures in the cover in accordance with the invention. These views are schematic views for purposes of illustrating the invention, and it is understood that the actual molds used will be designed for particular products in accordance with standard thermoforming practices. As shown in FIG. 7, a sheet of thermoplastic material 70 is held at its edges 71 and is advanced over a forming mold 72. Heat is applied (e.g., from radiant heaters) to the sections of the plastic sheet 70 to heat it to or above its plastic transition temperature. The mold 72 has recessed mold surfaces 74 with vacuum channels 75 therein to which vacuum pressure is then applied to draw the softened sheet 70 down into the mold so that it conforms closely to the surfaces 74 of the mold while a mold plug 76 is advanced into the sheet to press it into the mold 72. As illustrated in FIG. 9, as the sheet 70 is drawn into the mold it engages forming pins 79 of articulatable forming tools 78. The pins 79 press into the softened plastic sheet to form indentations, for example, the indentations 68 in the cover as discussed above. A vacuum draw is applied around the pins 79 to pull the softened plastic over the pins. The indentations 48 in the receptacle may be formed in the same way, if desired, although the relatively shallow female indentations 48 can be formed in a conventional thermoforming mold with appropriate mold surface features. The plastic sheet is allowed to cool and harden, after which the articulated tools 78 are then rotated back to their withdrawn position as shown in FIG. 10, withdrawing the forming pins from the indentations, as the formed sheet is removed from the mold. The formed plastic part 81 (the plastic material formed by the surfaces of the mold) is cut from the surrounding portions of the sheet 70 (e.g., by die cutting) and is removed from the mold in a conventional fashion, e.g., by air pressure to blow the formed and cut part out of the mold. The forming tool 78 rotates around a pivot pin 80 from a retracted position, shown in FIGS. 11 and 13, to an advanced position, shown in FIGS. 12 and 14, in which the forming pin 79 engages into the softened plastic to form the indentation as the plastic sheet is drawn into the mold. The pivot pin 80 could be connected to a driver (not shown), such as a solenoid, air cylinder, stepper motor, etc., which would rotate the tool 78 about the pivot pin 80 at an appropriate time in the forming cycle. However, the forming tool 78 is preferably formed to rotate by gravity about the pivot pin 80 to the advanced position of the forming pin 79 shown in FIGS. 12 and 14, and to freely rotate as the formed sheet is withdrawn from the mold to withdraw the pins from the formed part. A pivot pin stop base 82 having a detent post 83 is mounted under an overhang 84 of the tool 78 and engages the surface 84 when the tool is rotated backwardly, as illustrated in FIG. 13, to halt further rotation of the tool. The detent posts are preferably threaded, as illustrated in FIGS. 13 and 14, and screw into threaded holes in the pin stop base 82 to allow the height of the posts to be adjusted. Generally, with the use of a rounded head pin 79 as illustrated in the figures, the withdrawal of the formed plastic part from the mold will force the pin 79 out of the formed indentation (e.g., the indentation 68) to thereby force rotation of the tool 78 backwardly about its pivot 80 until engagement with the detent 83. After the formed part is removed, the tool 78 will then rotate by gravity back to the advanced position shown in FIGS. 12 and 14. Although the forming tool 78 that rotates to advance or retract the forming pin 79 is a preferred structure, the forming pins 79 may be advanced and retracted by any other desired means, for example by a double acting air cylinder connected to the forming pins. Formation of the indentations 68 in the foregoing manner is preferred because the forming pins 79 neither interfere with, nor delay, nor require any modification of, the normal thermoforming process.

In accordance with the invention, the cover 22 can thus be thermoformed separately from the receptacle 21, thereby allowing the cover and receptacle to be formed of different plastics, having different colors, different gauges, finishes, etc. Moreover, the cover or receptacle or both may be formed of thermoformable materials, such as polystyrene, which are not generally feasible for use in packaging that incorporates a living hinge. However, the cover and base may be formed of any thermoplastic, such as polyethylene, polypropylene, polyethylene terephthalate, polyvinyl chloride, etc., which can be thermoformed. The separate receptacle 21 and cover 22 are well adapted for compact shipping from the place of manufacture of the containers to the factory where the containers are filled, since the receptacles 21 are preferably formed to nestably stack, and the covers 22 also preferably may be nestably stacked together for shipment. The separately stacked covers and receptacles may thus be more compactly and less expensively shipped than is typically possible with containers having an integral cover and receptacle, which leave more dead air space when the containers are stacked. Moreover, the separate receptacles 21 are readily suited to being filled on automated equipment without interference from an integral cover extending from the receptacle. After the receptacles are filled, the covers 22 may be secured thereto by simply bringing the cover 22 over the top of the receptacle 21 and pressing the cover onto the top rim of the receptacle until the inwardly extending pivot pins 69 formed by the indentations 68 on the cover engage into the inwardly extending indentations 48 on the receptacle. The flanges and rims on the cover are preferably formed to fit over the flange and rim on the receptacle as illustrated in the figures to form a snug fit of the cover onto the receptacle when the cover is closed. The engagement of the cover and receptacle may be sufficiently tight as to provide a partial seal to inhibit drying of the contents of the container.

It is understood that the invention is not confined to the particular embodiments set forth herein as illustrative, but embraces all such forms thereof as come within the scope of the following claims.

What is claimed is:

1. A reclosable thermoformed hinged container comprising:

(a) a receptacle with an open top formed of a thermoformed sheet of plastic material, the receptacle having a hinge edge at its top, a hinge flange extending outwardly from the hinge edge, side skirt walls extending from the hinge flange generally perpendicular to the hinge edge, and an indentation formed in each side skirt wall; and (b) a cover formed of a thermoformed sheet of plastic material, the cover having a hinge edge, a hinge flange extending outwardly from the hinge edge, side skirt walls extending from the hinge flange generally perpendicular to the hinge edge, and an indentation formed in each of the side skirt walls of the cover, the cover sized to fit over and close the open top of the receptacle, wherein the indentations formed in the side skirt walls of one of the cover or the receptacle form hinge pins which seat into the indentations formed on the side skirt walls of the other of the cover or receptacle to define a hinge about which the cover can be rotated between open and closed positions of the cover.

2. The container of claim 1 wherein the hinge flange on the cover is formed to fit over the hinge flange on the receptacle with the side skirt walls of the cover extending down over and adjacent to the side skirt walls on the receptacle, the indentations in the side skirt walls of the cover and receptacle extending inwardly from each side skirt wall along an axis of rotation, the indentations formed in the side skirt walls of the cover forming hinge pins which seat in sockets defined by the indentations in the side skirt walls of the receptacle to form the hinge about which the cover is thereby hingedly and detachably attached to the receptacle.

3. The container of claim 2 further including an outer skirt wall descending from the hinge flange on the cover and integrally joined to the side skirt walls of the cover, and an outer skirt wall descending from the hinge flange of the receptacle and integrally joined to the side skirt walls of the receptacle.

4. The container of claim 2 wherein the receptacle includes a rim extending around the perimeter of the open top of the receptacle except where the hinge flange extends from the hinge edge, the rim comprising an outwardly extending flange and a skirt wall that extends downwardly from the outwardly extending flange and is formed integrally therewith.

5. The container of claim 4 further including a downwardly facing pocket formed around the perimeter of the cover which is formed to receive and fit over the rim on the receptacle when the cover is closed onto the receptacle.

6. The container of claim 5 wherein the receptacle includes a latch protrusion formed in the rim at a front of the receptacle which extends outwardly from adjacent portions of the skirt of the rim to form an undercut surface, and wherein the cover includes an outwardly extending latch section formed at the front edge of the cover which is formed to fit over and engage with the latch protrusion formed in the rim of the receptacle to lock the cover in its closed position over the receptacle.

7. The container of claim 1 wherein the cover or the receptacle or both are formed of a plastic selected from the group consisting of polystyrene, polyethylene, polypropylene, polyvinyl chloride, and polyethylene terephthalate.

8. The container of claim 1 wherein the cover and the receptacle are thermoformed from sheets of two different plastic materials.

9. The container of claim 1 wherein the cover and receptacle are thermoformed from sheets of two different colored plastic materials.

10. The container of claim 1 wherein the receptacle has a bottom wall, a front wall, a back wall, a left sidewall and a right sidewall integrally joined together to form the receptacle having a generally rectangular open top, and wherein the cover has a rectangular periphery matching the open top of the receptacle.

11. A reclosable thermoformed hinged container comprising:

(a) a receptacle with an open top formed of a thermoformed sheet of plastic material, the receptacle having a hinge edge at its top, a hinge flange extending outwardly from the hinge edge, side skirt walls extending from the hinge flange generally perpendicular to the hinge edge, and an indentation formed in each side skirt wall; and (b) a cover formed of a thermoformed sheet of plastic material, the cover having a hinge edge, a hinge flange extending outwardly from the hinge edge, side skirt walls extending from the hinge flange generally perpendicular to the hinge edge, and an indentation formed in each of the side skirt walls of the cover, the cover sized to fit over and close the open top of the receptacle, wherein the hinge flange on the cover is formed to fit over the hinge flange on the receptacle with the side skirt walls of the cover extending down over and adjacent to the side skirt walls on the receptacle, the indentations in the side skirt walls of the cover and receptacle extending inwardly from each side skirt wall along an axis of rotation, the indentations in the side skirt walls of the cover forming hinge pins which seat in sockets defined by the indentations in the side skirt walls of the receptacle to form a hinge about which the cover is thereby hingedly and detachably attached to the receptacle.

12. The container of claim 11 further including an outer skirt wall descending from the hinge flange on the cover and integrally joined to the side skirt walls of the cover, and an outer skirt wall descending from the hinge flange of the receptacle and integrally joined to the side skirt walls of the receptacle.

13. The container of claim 11 wherein the receptacle includes a rim extending around the perimeter of the open top of the receptacle except where the hinge flange extends from the hinge edge, the rim comprising an outwardly extending flange and a skirt wall that extends downwardly from the outwardly extending flange and is formed integrally therewith.

14. The container of claim 13 further including a downwardly facing pocket formed around the perimeter of the cover which is formed to receive and fit over the rim on the receptacle when the cover is closed onto the receptacle.

15. The container of claim 14 wherein the receptacle includes a latch protrusion formed in the rim at a front of the receptacle which extends outwardly from adjacent portions of the skirt of the rim to form an undercut surface, and wherein the cover includes an outwardly extending latch section formed at the front edge of the cover which is formed to fit over and engage with the latch protrusion formed in the rim of the receptacle to lock the cover in its closed position over the receptacle.

16. The container of claim 11 wherein the cover or the receptacle or both are formed of a plastic selected from the group consisting of polystyrene, polyethylene, polypropylene, polyvinyl chloride, and polyethylene terephthalate.

17. The container of claim 11 wherein the cover and the receptacle are thermoformed from sheets of two different plastic materials.

18. The container of claim 11 wherein the cover and receptacle are thermoformed from sheets of two different colored plastic materials.

19. The container of claim 11 wherein the receptacle has a bottom wall, a front wall, a back wall, a left sidewall and a right sidewall integrally joined together to form the receptacle having a generally rectangular open top, and wherein the cover has a rectangular periphery matching the open top of the receptacle.

* * * * *